US006195520B1

(12) United States Patent
Liu et al.

(10) Patent No.: US 6,195,520 B1
(45) Date of Patent: Feb. 27, 2001

(54) METHOD AND APPARATUS FOR FORMING A UNIFORM LAYER OF LIQUID DEVELOPER

(75) Inventors: Chu-Heng Liu, Penfield; John Chinnici, Rochester; Rodney B. Proulx; Paul W. Morehouse, Jr., both of Webster; Anthony M. Wallace, Penfield, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/407,701

(22) Filed: Sep. 28, 1999

(51) Int. Cl.[7] ..... G03G 15/10
(52) U.S. Cl. ..... 399/237; 399/249
(58) Field of Search ..... 399/237, 249

(56) References Cited

U.S. PATENT DOCUMENTS 4,127,082 * 11/1978 Kawabata ..... 399/249 X
4,325,627 * 4/1982 Swidler et al. ..... 399/249
4,482,242 * 11/1984 Moraw et al. ..... 399/249
5,497,223 * 3/1996 Landa ..... 399/328
5,596,396 1/1997 Landa et al. ..... 399/237
5,815,779 * 9/1998 Abramsohn ..... 399/249
5,826,147 10/1998 Liu et al. ..... 399/237
5,937,243 8/1999 Liu et al. ..... 399/130
5,937,248 8/1999 Liu et al. ..... 399/237

* cited by examiner

*Primary Examiner*—Fred L Braun
(74) *Attorney, Agent, or Firm*—John L. Haack

(57) ABSTRACT

The present invention provides an apparatus for forming a uniform layer of liquid developer which apparatus includes, for example, a coater for depositing liquid developer on a first movable substrate to form a first toner layer; a second movable substrate for contacting the first toner layer on the first substrate to form a uniformly thin second toner layer on the first substrate, wherein the directional movement of the first movable substrate surface is contrary to the directional movement of the second movable substrate surface, and wherein at least one of the first substrate surface and the second substrate surface conforms to an opposing surface; and a photoactive member for receipt and formation of latent image thereon and for receipt of a toner layer for development of the latent image by the toner layer.

19 Claims, 2 Drawing Sheets

METHOD AND APPARATUS FOR FORMING A UNIFORM LAYER OF LIQUID DEVELOPER

REFERENCE TO COPENDING APPLICATIONS

Attention is directed to commonly owned and assigned U.S. Pat. Nos. 5,826,147 and 5,937,243.

Attention is directed to commonly owned and assigned Application Number, U.S. Ser. No. 08/963,360 filed Nov. 3, 1997, now abandoned, entitled "Method and Apparatus for Liquid Developing Material Based Latent Image Development"; and Application Number, U.S. Ser. No. 09/182,786 filed Oct. 30, 1998, now U.S. Pat. No. 5,989,769, entitled "Liquid Developers and Processes Thereof."

The disclosure of the above mentioned patents and copending applications are incorporated herein by reference in their entirety. The appropriate components and processes of the disclosures may be selected for the apparatus, inks, and processes of the present invention in embodiments thereof.

BACKGROUND OF THE INVENTION

The present invention is generally directed to coating processes and coating conditioning processes for improved coating layers. More specifically, the present invention relates to improved coating processes and methods for improving or altering the properties of the resulting coating layer. The present invention can be applied to, for example, liquid development processes and imaging processes thereof providing, for example, improved coating and image cake forming processes, improved imaging processes, and improved imaging apparatuses.

There are certain prior art liquid toner development processes that use a thin layer or thin coating of high concentration toner materials as its development input. A problem associated with these prior art coating systems generally, and liquid development processes using a thin liquid toner layer specifically, particularly for highly viscous coating formulations such as certain liquid developers, is the inability to reliably form thin layers from high solids content coating formulations or developers. The problem is particularly evident for developer materials which are slightly to highly non-Newtonian and or strongly shear thinning. Additionally, paste or slurry-like materials can present other complications attributable to their strong yield stress and viscoelastic properties. In contrast, forming coatings of relatively dilute solutions or slurries, for example, with solids content of from about 1 to about 10 weight percent, is rather straight forward and uncomplicated. However, these dilute developers are disadvantaged and complicated by the need to remove a large excess of carrier fluid.

These and other problems are solved in embodiments of the present invention. The present invention provides in embodiments an apparatus and processes for forming very thin coatings with highly uniform thicknesses and high solids contents from either relatively dilute or relatively concentrated coating formulations or liquid developers.

PRIOR ART

In commonly owned and assigned U.S. Pat. No. 5,826,147, issued Oct. 20, 1998, to Liu, et al., there is disclosed a novel image development method and apparatus, wherein an imaging member having an imaging surface is provided with a layer of marking material thereon, and an electrostatic latent image is created in the layer of marking material.

Image-wise charging of the layer of marking material is accomplished by a wide beam ion source such that free mobile ions are introduced in the vicinity of an electrostatic latent image associated with the imaging member having the layer of marking material coated thereon. The latent image associated with the imaging member causes the free mobile ions to flow in an image-wise ion stream corresponding to the latent image, which, in turn, leads to image-wise charging of the toner layer, such that the toner layer itself becomes the latent image carrier. The latent image carrying toner layer is subsequently developed and transferred to a copy substrate to produce an output document.

In U.S. Pat. No. 5,596,396, issued Jan. 21, 1997, to Landa, et al., there is disclosed an imaging apparatus including a first member having a first surface having formed thereon a latent electrostatic image, the latent electrostatic image including image regions at a first voltage and background regions at a second voltage, a second member charged to a third voltage intermediate the first and second voltages and having a second surface adapted for resilient engagement with the first surface and a third member adapted for resilient contact with the second surface in a transfer region. The imaging apparatus also includes apparatus for supplying liquid toner to the transfer region thereby forming on the second surface a thin layer of liquid toner containing a relatively high concentration of charged toner particles and apparatus for developing the latent image by the selective transfer of portions of the layer of liquid toner from the second surface to the first surface.

In commonly owned and assigned U.S. Pat. No. 5,937,248, issued Aug. 10, 1999, to Liu, et al., there is disclosed a printing machine and method for efficiently forming toner images such that a quantity of unused toner applied to a photoreceptor of the machine is significantly diminished. The printing machine and method include a movable photoreceptor having a photoconductive surface for supporting electrostatic charge; a first charging device for selectively charging only scattered portions of the surface of the photoreceptor; a liquid developer material supply and application apparatus for applying a coat of charged toner solids having a single polarity onto each charged selected scattered portion, thereby forming an image area patch of toner; an exposure device for image-wise exposing each charged selected scattered portion to form a first latent image therein; and a contact electrostatic printing (CEP) assembly including a conductive (CEP) roll and a bias source coupled thereto, for applying compressive and tensile forces to the image area centered patches of toner moving through an image processing nip formed by the photoconductive surface of the photoreceptor and the conductive CEP roll, wherein the bias source cooperates with a charge pattern of the image area centered patches of toner to generate image-wise electric fields within the image processing nip, and the image-wise electric fields together with the compressive and tensile forces, enable easy separation of background area toner solids from image area toner solids of the image area centered patches of toner, and onto the CEP roll; thereby resulting in an efficiently produced, quality toner image with significantly reduced non-development marking material generated and requiring removal.

In commonly owned and assigned U.S. Pat. No. 5,937,243, issued Aug. 10, 1999, to Liu, et al., there is disclosed a novel image development method and apparatus, whereby image-wise charging of a toner layer is accomplished by induced air breakdown electrical discharge such that free mobile ions are introduced in the vicinity of an electrostatic latent image coated with a layer of developing material. The latent image causes the free mobile ions to flow in an image-wise ion stream corresponding to the latent image, which, in turn, leads to image-wise charging of the toner layer, such that the toner layer itself becomes the latent image carrier. The latent image carrying toner layer is subsequently developed and transferred to a copy substrate to produce an output document.

The disclosures of the above mentioned patents are incorporated herein by reference in their entirety.

SUMMARY OF THE INVENTION

Embodiments of the present invention, include:

A process comprising:

forming a first coating layer on a first movable substrate surface with a liquid developer; and contacting the resulting first coating layer on the first substrate with a second movable substrate surface to produce a thin uniform second coating layer on the first movable substrate surface, wherein the directional movement of the first movable substrate surface opposes the directional movement of the second movable substrate surface, and wherein at least one of the first substrate surface and the second substrate surface conforms to an opposing surface; and A printing machine comprising:

a coater adapted for depositing a liquid developer on the surface of a first movable substrate to form a first toner layer;

a second movable substrate adapted for contacting the first toner layer on the first substrate to form a uniformly thin second toner layer on the first substrate, wherein the directional movement of the first movable substrate surface is contrary to the directional movement of the second movable substrate surface, and wherein at least one of the first substrate surface and the second substrate surface conforms to an opposing surface; and a photoactive member adapted for receipt and formation of latent image information thereon and further adapted for receipt of a toner layer to permit development of the latent image information by the toner layer.

These and other embodiments of the present invention are illustrated herein.

DETAILED DESCRIPTION OF THE INVENTION

The coating processes and coating conditioning processes of the present invention provide simple and effective solutions to the problem of forming very thin coating layers from highly viscous materials, encountered, for example, in some liquid ink development printing systems which employ concentrated or conventional liquid electrostatic toner or ink developer formulations.

The present invention provides coating processes which can produce a very thin layer or multiple or compound thin layers of high uniformity and thickness from highly viscous materials, such as paste-like or non-Newtonian substances.

In embodiments the present invention provides, a process comprising:

forming a first coating layer on a first movable substrate surface with a liquid developer; and contacting the resulting first coating layer on the first substrate with a second movable substrate surface to produce a thin uniform second coating layer on the first movable substrate surface, wherein the directional movement of the first movable substrate surface opposes the directional movement of the second movable substrate surface, and wherein at least one of the first substrate surface and the second substrate surface conforms to, or is conformable to, an opposing surface.

The contacting of the resulting first coating layer on the first substrate with the second movable substrate surface creates a self-spacing gap between the first and second movable surfaces, and the gap or separation between the first and second surfaces can be controlled or varied by the relative opposing speeds of the two movable surfaces.

The contact established by contacting the first and second movable substrates, where either or both first and second surfaces is conformable, in the presence of a coating layer, is believed to provide significant advantages over prior art coating methods where, for example, a nip or gap of known dimension is pre-selected and set between two movable surfaces and in the absence of a coating material.

Figure 1:
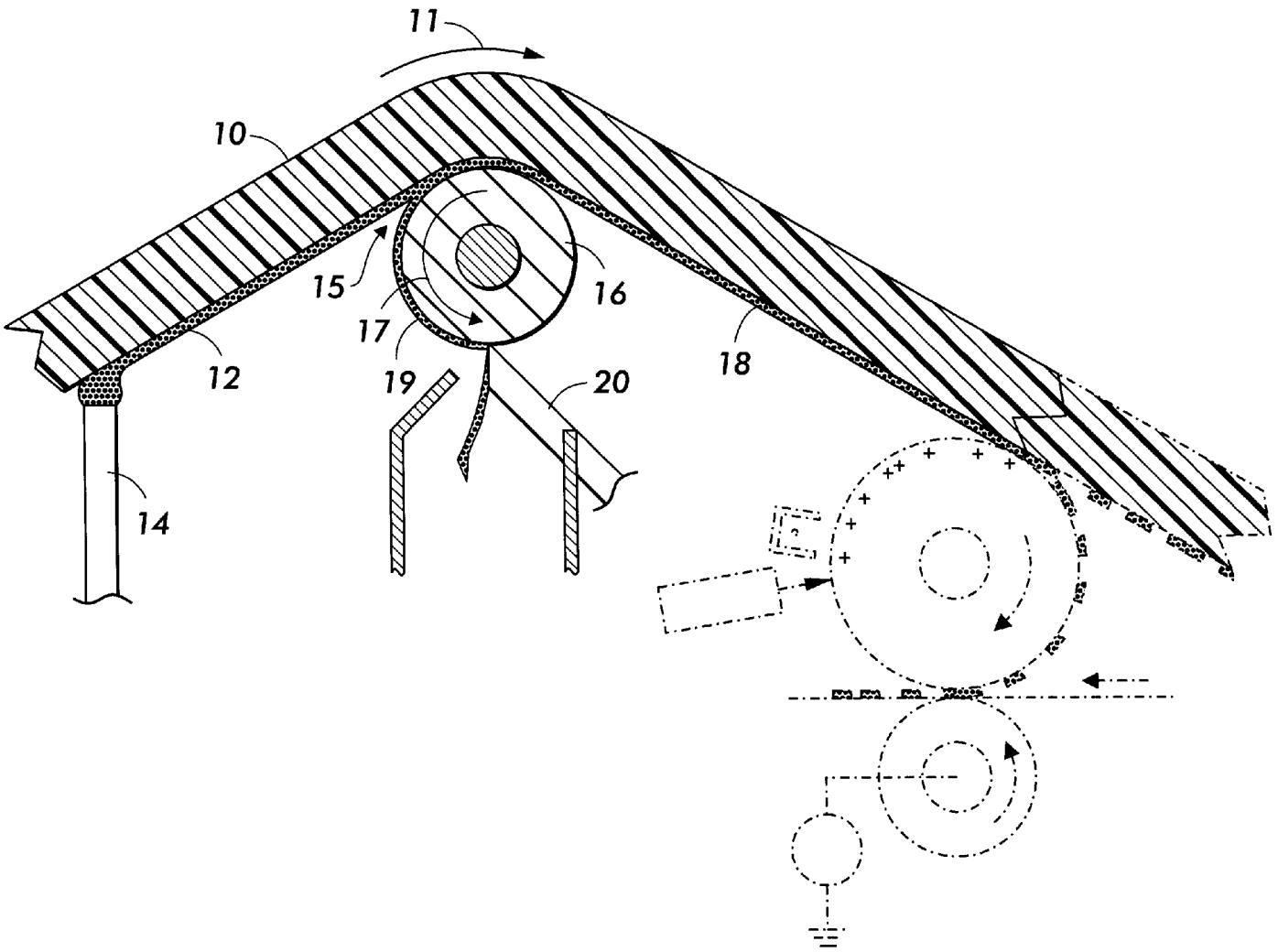
FIG. 1 is a side view-section of exemplary components of an illustrative coating apparatus of the present invention.

Referring to the Figures, in FIG. 1, there is illustrated a first movable substrate(10) or alternatively referred to as a coating bearing surface, shown as a flexible or conformable belt, which first movable substrate moves in the process direction indicated by the accompanying directional arrow (11). Onto the first movable substrate(10) is coated, in the upstream process direction, a thick or thin first coating layer(12) from the deposition of coating material from a suitable coating applicator(14). The first coating layer(12) is advanced to a self-spacing or contact-less nip(15) formed from the confluence of first movable substrate(10) bearing the first coating layer(12) and a second movable substrate, or alternatively referred to as a metering surface, shown as roller(16) operating in an opposite or opposing process direction(17) to produce a second coating layer(18) of relatively reduced thickness and increased uniformity compared to first coating layer(12). Excess coating material(19) can be conveniently metered out on opposing substrate(16) surface and recovered and reused by removal from the substrate surface with, for example, a blade cleaner(20).

FIG. 1 illustrates the formation of a desired coating with a desired coating thickness through smoothing and thinning of the first coating layer. Alternatively, it can be equally effective to "flood" the nip entrance, that is to provide adequate or excess coating material supply to the nip region. More specifically, the coating applicator(14) can be moved closer to the coating nip and positioned so that the coating material can be directly supplied to the interface region between the first and the second surfaces.

Reverse metering coating technique as practiced in a traditional liquid development processes can also be adapted as a toner layer cake formation method as illustrated in the present invention. The traditional coating processes apply an excess of dilute liquid toner to a movable surface and then uses a second metering surface, which is previously set at a tightly controlled separation from the first surface, and which second surface is opposing or moving oppositely to the first surface, and removes the excess developer from the first surface to form a thin layer of developer on the first surface. This traditional approach is problematical when a very thin and highly viscous toner coating is desired as the output and as required by some image development processes. In this traditional process, the nip or gap between the first and the second surface is typically set at around 100 microns through accurate positioning and precision parts. The process capability for coating thickness and toner concentration is very limited.

To produce a thin concentrated film or toner layer, for example, greater than about 20 percent solids content liquid toner layer at about 5 microns thick, a narrow nip or gap in the range of about 10 to about 30 microns is required.

An aspect of the present invention which distinguishes it from a traditional metering coating scheme discussed above is the presence of "virtual contact" of the metering nip where the two moving surfaces are in good contact in the absence of the coating materials. When coating materials are supplied to the metering region the hydrodynamic pressure separates the two surfaces at a small distance to form a self-spaced coating nip. In contrast to the traditional pre-spaced metering approach the gap used in the present invention is controlled by the viscosity of the material and the speeds of the two opposing moving surfaces. Due to the small and stable separation between the two opposing moving surfaces in the present invention, there is enabled a high speed toner layer formation process that is capable of forming coating layers with excellent uniformity, small coating thicknesses, and high solid contents.

To form a virtual contact in accordance with the present invention, either of the two opposing moving surfaces provide at least some amount of compliance so that the opposing moving surfaces can be partially displaced and separated from the other surface to form a self-spacing nip when hydrodynamic pressure attributable to the coating materials is present in the nip.

For example, in FIG. 1, the tension section and not the back supported section of the belt can provide the compliance or conformability. Alternatively, a conformable surface, such as a roll or belt, a spring loaded, or a spring backed surface can achieve the desired level of compliance.

Figure 2:
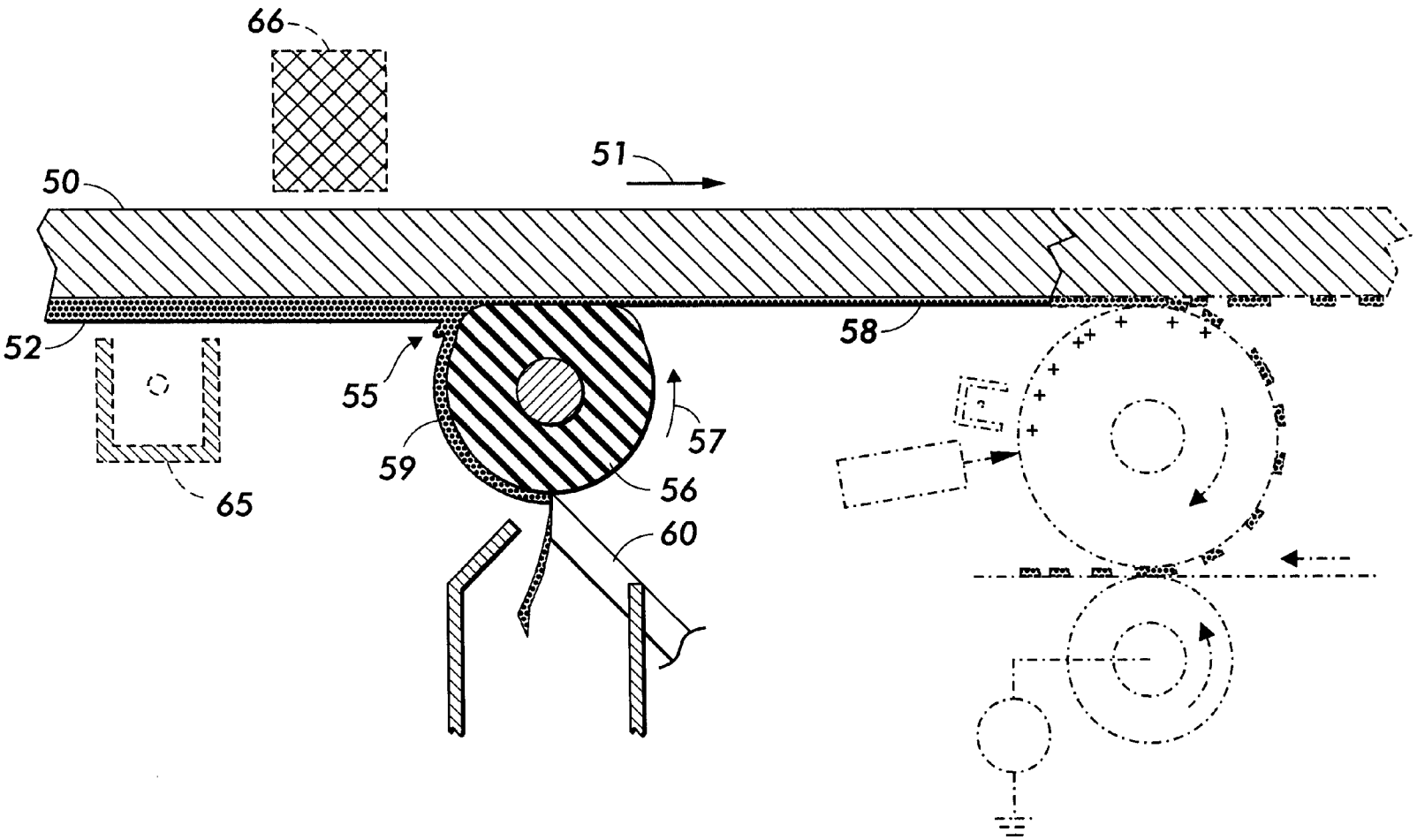
FIG. 2 is a side view-section of exemplary components of another illustrative coating apparatus of the present invention.

Referring to FIG. 2, there is illustrated an alternative configuration for the coating apparatus and process of the present invention. A first movable substrate(50) shown as an inflexible, rigid, or non-conforming surface, moves in the process direction (51). Onto the first movable substrate(50) can be deposited or coated in the upstream process direction a thick or thin first coating layer(52) from the deposition of coating material from a suitable coating applicator nozzle (not shown). The first coating layer(52) is advanced to a contact-less nip(55) formed from the confluence of first movable substrate(50) bearing the first coating layer(52) and a second movable conformable substrate or metering surface, shown as conformable roller(56) operating in an opposite or opposing process direction(57) to produce a second coating layer(58) of relatively reduced thickness and increased uniformity compared to first coating layer (52). Excess coating material(59) can be conveniently metered out on opposing substrate(56) surface and recovered and reused by removal from the opposing substrate surface with, for example, a blade cleaner(60).

In the case of electrophoretic materials, such as liquid toner, the apparatus can optionally include adapting the coating nip for electrostatic biasing so that an induced or applied electrostatic field can be used to concentrate the coating materials so that the resulting coating layer has a different concentration from the input coating material, for example, a concentration gradient of ingredients in the resulting coating layer. The electrostatic bias thus enables coating concentration control and coating thickness control. Application of bias can also greatly enhance the process latitude against coating defects because of the stabilization of the toner particles by the electrical fields. As it is well known in the art, the biases can be implemented in a number of different ways, such as biased rolls, biased belts, and the like biasing articles.

The apparatus can include an optional charger(65), such as a known corona charging device, and additionally or alternatively, the apparatus can include an optional magnetic member(66), such as a known magnetic coil, a bar magnet, or a series of bar magnetic. The charger and the magnetic member can be used alone, or in combination, to further prepare the coating for thinning interaction with the opposing second substrate member(56) or for conditioning of the first coating layer. It will be readily appreciated by one of ordinary skill in the art that the charger and or the magnetic member can alternatively be positioned in an area downstream from the conformable nip region (55) and in proximity to the second coating layer (58) for the purpose of further conditioning or manipulating the thinned coating layer for subsequent unit operations, such as transfer to a photoreceptor member or an image receiver member(not shown) in the situation, for example, where the conforming second substrate surface(56) or non-conforming surface(50) is a photoactive imaging member.

The aforementioned opposing or opposite directional movement of the movable substrate surfaces refers to the relative motion of the contacting substrate surfaces as viewed, for example, from a point within the nip formed by the confluence of the first and second movable substrates with a coating layer therebetween. Thus for example where the first and second movable substrates are rollers, the rolls rotate in the self-same direction, such as both rotating in a clockwise fashion, or alternatively both rotating in a counter clockwise fashion, so that the relative motion of the substrate surfaces with respect to each other is contrary to or in opposition to the motion of the other opposing roll.

In embodiments at least one of the first movable substrate and the second movable substrate and their corresponding surfaces can be conformable to an opposing non-conformable substrate surface. In other embodiments the first and the second movable substrates and their corresponding surfaces can both be conformable with respect to an opposing movable substrate surface.

The contact of the first movable substrate surface and the second movable substrate surface forms a nip region between the first and the second movable substrates. In the absence of an added coating layer on either substrate surface the contact is substantially complete and there is no apparent gap or void space between the contacting first and second movable substrate surfaces. When a coating layer on the first movable substrate is contacted by the second movable substrate the hydrodynamic lift resulting from the material flow at the nip entrance separates the first and second movable substrate surfaces and creates or causes a very thin layer of coating material to form in between the movable substrates. At the nip exit the opposing second movable substrate metering surface further meters the coated material within the nip gap to produce an even thinner coating.

The present invention is capable of achieving: high speed coating operation and throughput; high uniformity of the resulting coating layer; very thin coating layers; and conditioned coating layers with high solids content. In embodiments, the present coating process and apparatus can be adapted for use with electrostatographic toner charging and which toner modified process is capable of producing high solid content toner layers from relatively low solid content toner supply, for example, as commonly found in commercial liquid developer formulations with low solids content of from about 1 to about 10 weight percent, to form coatings with high solids contents of from about 5 to about 50 weight percent and above.

The first and second coating layers can be of various uniform thicknesses depending upon a number of factors and operator selectable and controllable parameters.

The first coating layer can have thickness of from about 30 to about 1,000 microns. The second coating layer can have a thickness of from about 1 to about 200 microns, and in embodiments, preferably from about 0.5 to about 15 microns. The thickness of the first coating layer can be from about 1.5 to about 30 times greater than the thickness of the resulting second coating layer, that is, the first coating layer is preferably in considerable excess supply just prior to the nip entrance region.

The gap of the virtual contact is controlled by the hydrodynamic lift and the compliance of the two surfaces. Depending on the coating material viscosity and the speed ratio of the opposing surfaces the level of compliance between the two surfaces can be adjusted accordingly. In general, it is preferable that the second movable surface move slower than the first movable surface to provide sufficient lift especially in the case of dilute developers. In addition to the coating thickness control, and for contact and image quality concerns, such as streaks, bands and other coating defects, the speed of the second movable surface, that is the metering surface, should be within a certain range in order to prevent imaging defects, such as ribbing below the low speed limit, and banding above the high speed limit. In the absence of coating solid stabilization methods, such as bias, charging, and the like methods, a typical speed range for the second surface is from about 30 to 100 percent of the first movable surface. A preferred speed range for the second surface is from about 30 to about 70 percent of the first movable surface. When coating solid stabilization methods, such as electrostatic bias, is applied the speed range can be increased substantially. For example, a speed range differential from about 0 to 300% can produce good coating with desired coating thickness and concentration. In embodiments, the relative speed differential or ratio of the first movable surface to the second movable surface can be, for example, from about 1:3 to about 0.2:1.

Net coating speeds achievable in the present invention are from about 1 to about 100 inches per second, and preferably from about 5 to about 50 inches per second.

The first and second movable substrate surfaces are preferably mechanically robust and chemically inert with respect to the liquid developer. The first and second movable substrates are preferably capable of withstanding continuous operation at high speed for many thousands of hours and thousands of imaging cycles without deterioration or failure. The first and second movable substrates can be constructed and configured from, for example, drums, belts, rollers, webs, and the like endless surface geometries to provide continuously moving and effectively renewable surfaces.

In embodiments where the coating includes electrostatically active particulates or additives, such as liquid developers containing electrostatically chargeable or charged toner particles, the process can further comprise electrostatically charging the first coating layer on the first substrate prior to contacting the coating layer with the second substrate. The electrostatically active particles within the first coating layer can be readily concentrated into close proximity with the first substrate surface. Electrostatic charging of the first coating layer can be accomplished by known conventional charging methods such as corona discharge and the like methods.

Similarly or additionally, where the coating includes magnetically active particulates or additives the process can include magnetically biasing the first coating layer on the first substrate prior to contacting with the second substrate. The magnetically active particles within the first coating layer can be readily concentrated in close proximity to the first substrate surface. Magnetic biasing of the first coating layer can be accomplished by known conventional methods, such as one or more electromagnetic coils, one or more bar magnets, and the like magnetization methods, and which magnet forces are preferably situated in close proximity to the first substrate surface, preferably the on the uncoated back-side, that is the first substrate side opposite the coating bearing surface.

In embodiments the present invention, if desired, can be extended to further include additional coating and or coating conditioning steps, for example, contacting the resulting second coating layer on the first substrate with a third movable substrate surface to produce a third thin uniform coating layer on the first movable substrate surface, and wherein the directional movement of the first movable substrate surface opposes the directional movement of the third movable substrate surface.

In embodiments the first coating layer can have a solids content of from about 1 to about 30 weight percent, and preferably from about 5 to about 20 weight percent. The second coating layer can have a solids content of from about 5 to about 50 weight percent, and preferably from about 10 to about 35 weight percent. In embodiments the present invention provides coating processes and apparatus that can be adapted to afford coatings where the solids contents per unit area on the first movable substrate surface in the first coating layer and in the second coating layer can be substantially the same, for example, where the solids content in the respective layers are within from about 0.1 to about 5 weight percent. Alternatively the coating processes and apparatus of the present invention can be adapted to provide coatings on the first movable substrate surface where the liquid carrier contents in the first coating layer and in the second coating layer are substantially different, for example, where the solids content in the respective layers differ by from about 5 to about 80 weight percent.

The liquid developer can be any known liquid developer formulation that can be adapted for use in the present process and apparatus, and can include, for example, mixtures of a resin, a colorant, a carrier liquid, and various performance additives known in the art, such as internal and external charge control additives, charge directors, and the like additives.

The liquid developer can have a ambient or operational viscosity of from about 1 to about 200,000 centipoise, and preferably from about 100 to about 100,000 centipoise.

The first movable substrate and the second movable substrate can be independently constructed of suitable flexible or rigid materials, such as rubber, plastics, polymeric films, metalized plastic films, metals, alloys, composites, ceramers, and combinations thereof.

The present invention in embodiments provides a printing machine comprising:

a coater adapted for depositing a liquid developer on the surface of a first movable substrate to form a first toner layer;

a second movable substrate adapted for contacting the first toner layer on the first substrate to form a uniformly thin second toner layer on the first substrate, wherein the directional movement of the first movable substrate surface is contrary to the directional movement of the second movable substrate surface, and wherein at least one of the first substrate surface and the second substrate surface conforms to an opposing surface; and a photoactive member adapted for receipt and formation of latent image information thereon and further adapted for receipt of a toner layer to permit development of the latent image information by the toner layer.

In embodiments, the first movable substrate can be the photoactive member. In other embodiments, the first movable substrate bearing the uniformly thin second toner layer can be adapted to transfer the second toner layer to the a photoactive member.

Liquid developer and related compositions and processes for their preparation are known, reference for example, U.S. Pat. Nos. 5,563,015, 5,565,299, 5,567,564, 5,382,492, 5,714,993, 5,570,173, and 5,612,777, the disclosures of which are incorporated herein by reference in their entirety.

The invention will further be illustrated in the following non limiting Examples, it being understood that these Examples are intended to be illustrative only and that the invention is not intended to be limited to the materials, conditions, process parameters, and the like, recited herein. Parts and percentages are by weight unless otherwise indicated.

EXAMPLE I

Preparation of Liquid Developer

A resin such as polyethylene-methacrylic acid commercially available as NUCREL RX76®, 25 grams, 15 weight percent Hostaperm Pink, 0.7 weight percent Witco 22, and ISOPAR® L (170 g) were added to a Union Process O1 shot mill attritor equipped with ⅜-inch stainless steel shot (2,500 g). The mixture was stirred at 50 rpms while the reactor contents were heated with steam to about 200° F. Steam heating was then discontinued and stirring at ambient temperature was continued for 2 hours while the temperature had reached 100° F. The reactor was then cooled by external jacketed cooling water while stirring was continued for 4 hours. The resulting ink was sieved to remove the steel shot and which shot was washed with ISOPAR® L and the combined washings were added to the filtrate. The resulting ink at 7 weight percent solids was centrifuged to form a toner concentrate at 15 weight percent solids.

EXAMPLE II

Liquid Development Process with Liquid

The liquid developer prepared in Example I was used for liquid development processes, for example, as disclosed in the aforementioned copending application U.S. Ser. No. 08/963,360, with the counter rotating, self-spacing, and conformable first and second substrate surfaces as described and illustrated in the present invention, with the result that highly uniform and concentrated liquid developer coatings were routinely and consistently achieved.

Other modifications of the present invention may occur to one of ordinary skill in the art based upon a review of the present application and these modifications, including equivalents thereof, are intended to be included within the scope of the present invention.

What is claimed is:

1. A process comprising:

forming a first coating layer on a first movable substrate surface with a liquid developer; and contacting the resulting first coating layer on the first substrate with a second movable substrate surface to produce a thin uniform second coating layer on the first movable substrate surface, wherein the directional movement of the first movable substrate surface opposes the directional movement of the second movable substrate surface, wherein at least one of the first substrate surface and the second substrate surface conforms to an opposing surface, and wherein the contacting forms a self-spacing nip region between the first and the second movable substrates which nip compresses and transforms the first coating layer on the first substrate in the nip region to a second coating layer after the nip region on the first substrate surface.

2. A process in accordance with claim 1, wherein both the first and the second substrates conforms to an opposing surface.

3. A process in accordance with claim 2, wherein the conformable aspect of the first and the second substrates is selected from the group consisting of a tensioned portion of a belt, a compliant roller surface, a spring loaded roll, a spring supported roll, a spring loaded belt, a spring supported belt, and combinations thereof.

4. A process in accordance with claim 1, wherein the first coating layer has a thickness of from about 1 to about 200 microns.

5. A process in accordance with claim 1, wherein the second coating layer has a thickness of from about 0.5 to about 15 microns.

6. A process in accordance with claim 1, wherein the thickness of the first coating layer is from about 1.5 to about 30 times greater than the thickness of the resulting second coating layer.

7. A process in accordance with claim 1, wherein the first movable substrate surface and the second movable substrate surface are mechanically robust and chemically inert with respect to the liquid developer.

8. A process in accordance with claim 1, further comprising electrostatically charging the first coating layer on the first substrate before contacting with the second substrate.

9. A process in accordance with claim 1, wherein the first and the second coating layers have substantially the same solids content concentration.

10. A process in accordance with claim 1, wherein the liquid developer comprises a resin, a colorant, a carrier liquid, and optional charge additives.

11. A process in accordance with claim 1, wherein the liquid developer has a viscosity of from about 20 to about 200,000 centipoise.

12. A process in accordance with claim 1, wherein either or both the first substrate and the second substrate are electrically biased.

13. A process in accordance with claim 1, wherein the relative speed ratio of the first movable surface to the second movable surface is from about 1:3 to about 0.2:1.

14. A process comprising:

forming a first coating layer on a first movable substrate surface with a liquid developer;

contacting the resulting first coating layer on the first substrate with a second movable substrate surface to produce a thin uniform second coating layer on the first movable substrate surface, wherein the directional movement of the first movable substrate surface opposes the directional movement of the second movable substrate surface, and wherein at least one of the first substrate surface and the second substrate surface conforms to an opposing surface; and magnetically biasing the first coating layer on the first substrate before contacting with the second substrate.

15. A process comprising:

forming a first coating layer on a first movable substrate surface with a liquid developer; and contacting the resulting first coating layer on the first substrate with a second movable substrate surface to produce a thin uniform second coating layer on the first movable substrate surface, wherein the directional movement of the first movable substrate surface opposes the directional movement of the second movable substrate surface, and wherein at least one of the first substrate surface and the second substrate surface conforms to an opposing surface, wherein the first coating layer has a solids content of from about 1 to about 30 weight percent and wherein the second coating layer has a solids content of from about 5 to about 50 weight percent.

16. A process comprising:

forming a first coating layer on a first movable substrate surface with a liquid developer; and contacting the resulting first coating layer on the first substrate with a second movable substrate surface to produce a thin uniform second coating layer on the first movable substrate surface, wherein the directional movement of the first movable substrate surface opposes the directional movement of the second movable substrate surface, and wherein at least one of the first substrate surface and the second substrate surface conforms to an opposing surface, wherein the solids contents per unit area on the first movable substrate surface in the first coating layer and in the second coating layer are similar and are within from about 0.1 to about 5 percent, and wherein the liquid carrier contents in the first coating layer and in the second coating layer differs by from about 5 to about 80 weight percent.

17. A printing machine comprising:

a coater adapted for depositing a liquid developer on the surface of a first movable substrate to form a first toner layer;

a second movable substrate adapted for contacting the first toner layer on the first substrate to form a uniformly thin second toner layer on the first substrate, wherein the directional movement of the first movable substrate surface is contrary to the directional movement of the second movable substrate surface, and wherein at least one of the first substrate surface and the second substrate surface conforms to an opposing surface; and a photoactive member adapted for receipt and formation of latent image information thereon and further adapted for receipt of the uniformly thin second toner layer on the first substrate to permit development of the latent image information by the uniformly thin second toner layer.

18. An printing machine in accordance with claim 17, wherein the first movable substrate is the a photoactive member.

19. An printing machine in accordance with claim 17, wherein the first movable substrate bearing the uniformly thin second toner layer is adapted to transfer the second toner layer to the photoactive member and thereafter to a printable receiver.

* * * * *